US010047972B2

(12) United States Patent
Jeong

(10) Patent No.: US 10,047,972 B2
(45) Date of Patent: Aug. 14, 2018

(54) INDOOR DEVICE FOR CASSETTE TYPE AIR CONDITIONER

(71) Applicant: LG Electronics Inc., Seoul (KR)

(72) Inventor: Changhoon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 830 days.

(21) Appl. No.: 14/504,823

(22) Filed: Oct. 2, 2014

(65) Prior Publication Data

US 2015/0090429 A1 Apr. 2, 2015

(30) Foreign Application Priority Data

Oct. 2, 2013 (KR) ..... 10-2013-0117925

(51) Int. Cl.

| | |
|---|---|
| ***F24F 13/08*** | (2006.01) |
| ***F24F 7/00*** | (2006.01) |
| ***F24F 13/20*** | (2006.01) |
| ***F24F 1/00*** | (2011.01) |

(52) U.S. Cl.

CPC ..... *F24F 13/085* (2013.01); *F24F 1/0011* (2013.01); *F24F 7/00* (2013.01); *F24F 13/084* (2013.01); *F24F 13/20* (2013.01); *F24F 2001/0037* (2013.01)

(58) Field of Classification Search

USPC ..... 454/248, 283, 292, 297, 296, 331, 332; 62/259.1

See application file for complete search history.

(56) References Cited

U.S. PATENT DOCUMENTS

| | | | | |
|---|---|---|---|---|
| 5,642,608 | A | 7/1997 | Sanderson | |
| 5,746,655 | A | 5/1998 | Lee | |
| 5,769,710 | A | 6/1998 | Kim | |
| 5,775,989 | A | 7/1998 | Choi | |
| 5,788,570 | A | 8/1998 | Cho | |
| 5,943,872 | A | 8/1999 | Sakurada et al. | |
| 6,089,972 | A | 7/2000 | Gunji | |
| 6,250,373 | B1 | 6/2001 | Vecchi | |
| 6,264,552 | B1 | 7/2001 | Oya | |
| 6,393,856 | B1 * | 5/2002 | Gunji | F24F 1/0011 62/259.1 |
| 6,692,349 | B1 | 2/2004 | Brinkerhoff et al. | |

(Continued)

FOREIGN PATENT DOCUMENTS

| | | |
|---|---|---|
| CN | 2420551 | 2/2001 |
| CN | 1478188 | 2/2004 |

(Continued)

OTHER PUBLICATIONS

European Search Report issued in Application No. 14188794.3 dated Jun. 24, 2015.

(Continued)

*Primary Examiner* — Gregory Huson
*Assistant Examiner* — Elizabeth M May
(74) *Attorney, Agent, or Firm* — KED & Associates, LLP

(57) ABSTRACT

An indoor device for a cassette type air conditioner is provided. In the indoor device, a suction grill restricter to couple the suction grill to a panel to prevent outer edges of the suction grill from drooping may be provided to maintain a more stable coupling state, preventing dew condensation and noise from occurring.

28 Claims, 13 Drawing Sheets

(56) References Cited

U.S. PATENT DOCUMENTS

| | | | | |
|---|---|---|---|---|
| 7,878,017 | B2 | 2/2011 | Yasutomi | |
| 7,908,879 | B1 | 3/2011 | Chen | |
| 7,992,794 | B2 | 8/2011 | Leen et al. | |
| 8,230,693 | B2 | 7/2012 | Tsuji | |
| 8,393,550 | B2 | 3/2013 | Simon et al. | |
| 8,511,108 | B2 | 8/2013 | Yabu | |
| 8,715,047 | B2 | 5/2014 | Kim | |
| 8,740,101 | B2 | 6/2014 | Leen et al. | |
| 8,746,583 | B2 | 6/2014 | Simon et al. | |
| 9,410,714 | B2 | 8/2016 | Tsuji | |
| 9,574,781 | B2 | 2/2017 | Tsuji | |
| 2001/0054493 | A1 | 12/2001 | Hatanaka | |
| 2003/0157883 | A1 | 8/2003 | Kwak | |
| 2004/0166797 | A1 | 8/2004 | Thrasher et al. | |
| 2005/0053465 | A1 | 3/2005 | Roach et al. | |
| 2005/0109047 | A1 | 5/2005 | Park et al. | |
| 2007/0066215 | A1 | 3/2007 | Song et al. | |
| 2007/0261425 | A1 | 11/2007 | Yasutomi | |
| 2009/0077987 | A1* | 3/2009 | Egawa | F24F 1/0007 62/259.1 |
| 2009/0199583 | A1 | 8/2009 | Jeon et al. | |
| 2010/0006660 | A1 | 1/2010 | Leen et al. | |
| 2010/0192610 | A1 | 8/2010 | Yoshitake et al. | |
| 2010/0193592 | A1 | 8/2010 | Simon et al. | |
| 2010/0225012 | A1 | 9/2010 | Fitton et al. | |
| 2010/0226801 | A1 | 9/2010 | Gammack | |
| 2010/0287966 | A1* | 11/2010 | Cha | F24F 1/0007 62/263 |
| 2011/0048057 | A1* | 3/2011 | Lee | F24F 13/28 62/408 |
| 2011/0137467 | A1 | 6/2011 | Leen et al. | |
| 2011/0319009 | A1 | 12/2011 | Nam | |
| 2012/0003917 | A1 | 1/2012 | Jeong | |
| 2012/0033952 | A1 | 2/2012 | Wallace et al. | |
| 2012/0214399 | A1 | 8/2012 | Tsuji | |
| 2012/0220212 | A1 | 8/2012 | Tsuji | |
| 2012/0288363 | A1 | 11/2012 | Yumoto et al. | |
| 2013/0186964 | A1 | 7/2013 | Simon et al. | |
| 2013/0280099 | A1 | 10/2013 | Park et al. | |
| 2014/0026604 | A1 | 1/2014 | Yoshimura | |

FOREIGN PATENT DOCUMENTS

| | | | | |
|---|---|---|---|---|
| CN | 1499141 | | 5/2004 | |
| CN | 1517613 | | 8/2004 | |
| CN | 1573239 | | 2/2005 | |
| CN | 1712808 | | 12/2005 | |
| CN | 1727764 | | 2/2006 | |
| CN | 101464041 | | 6/2009 | |
| CN | 201368569 | | 12/2009 | |
| CN | 101761986 | | 6/2010 | |
| CN | 101796349 | | 8/2010 | |
| CN | 102478304 | | 5/2012 | |
| CN | 102575869 | | 7/2012 | |
| CN | 202630252 | | 12/2012 | |
| EP | 0 884 542 | | 12/1998 | |
| EP | 0 926 451 | | 6/1999 | |
| EP | 1 003 002 | A2 | 5/2000 | |
| EP | 1 152 193 | | 11/2001 | |
| EP | 1271065 | A2 | 1/2003 | |
| EP | 1 326 055 | A1 | 7/2003 | |
| EP | 1 482 252 | A2 | 12/2004 | |
| EP | 1 533 577 | A1 | 5/2005 | |
| EP | 1 548 375 | A1 | 6/2005 | |
| EP | 1548375 | A1 * | 6/2005 | F24F 1/0007 |
| EP | 1 813 875 | A1 | 8/2007 | |
| EP | 1 816 406 | A2 | 8/2007 | |
| EP | 1 837 607 | A2 | 9/2007 | |
| EP | 1837607 | A2 * | 9/2007 | F24F 1/0007 |
| EP | 1 947 397 | A1 | 7/2008 | |
| EP | 2 017 542 | A1 | 1/2009 | |
| EP | 2023049 | A2 | 2/2009 | |
| EP | 2 199 695 | A1 | 6/2010 | |
| EP | 2 363 653 | A2 | 9/2011 | |
| EP | 2 498 018 | A1 | 9/2012 | |
| EP | 2 530 395 | A1 | 12/2012 | |
| EP | 3 006 840 | | 4/2016 | |
| JP | S58-173320 | A | 10/1983 | |
| JP | H11-148698 | A | 6/1999 | |
| JP | 2001-173982 | A | 6/2001 | |
| JP | 2002-228183 | A | 8/2002 | |
| JP | 2003-065558 | A | 3/2003 | |
| JP | 2004-138363 | A | 5/2004 | |
| JP | 2009-168347 | | 7/2009 | |
| JP | 2012-220110 | A | 11/2012 | |
| JP | 2003-042515 | | 2/2013 | |
| JP | 3183736 | U | 5/2013 | |
| KR | 1996-0004920 | Y1 | 6/1996 | |
| KR | 20-0161129 | | 11/1999 | |
| KR | 10-2000-0035591 | A | 6/2000 | |
| KR | 10-2005-0083664 | A | 8/2005 | |
| KR | 10-0583415 | B1 | 5/2006 | |
| KR | 10-2006-0062148 | | 6/2006 | |
| KR | 10-2007-0058682 | A | 6/2007 | |
| KR | 10-2007-0095141 | | 9/2007 | |
| KR | 10-0794596 | B1 | 1/2008 | |
| KR | 10-2008-0075632 | A | 8/2008 | |
| KR | 10-2007-0080383 | A | 2/2009 | |
| KR | 10-2010-0036919 | | 4/2010 | |
| KR | 20-2012-0001065 | U | 2/2012 | |
| KR | 10-2012-0082934 | A | 7/2012 | |
| WO | WO 2004/011854 | A1 | 2/2004 | |
| WO | WO 2004/040204 | | 5/2004 | |

OTHER PUBLICATIONS

U.S. Office Action dated Oct. 20, 2016 issued in U.S. Appl. No. 14/508,161.
Chinese Office Action dated Oct. 13, 2016.
Chinese Office Action dated Nov. 7, 2016.
Chinese Office Action dated Nov. 9, 2016 issued in Application No. 201410270547.3 (Translation).
Chinese Office Action dated Nov. 9, 2016 issued in Application No. 201410495092.5 (Translation).
U.S. Office Action issued in U.S. Appl. No. 14/508,161 dated Mar. 16, 2017.
Chinese Office Action dated Feb. 23, 2017 (English Translation).
European Search Report dated Feb. 24, 2015 issued in Application No. 14186801.8.
European Search Report issued in Application No. 14185283.0 dated Feb. 4, 2015.
European Search Report issued in Application No. 14185285.5 dated Feb. 4, 2015.
European Search Report issued in Application No. 14187785.2 dated Feb. 4, 2015.
Chinese Office Action dated Jul. 19, 2017 (English Translation).
U.S. Appl. No. 14/505,190, filed Oct. 2, 2014.
U.S. Appl. No. 14/508,161, filed Oct. 7, 2014.
U.S. Appl. No. 14/510,599, filed Oct. 9, 2014.
U.S. Appl. No. 14/510,340, filed Oct. 9, 2014.
United States Office Action dated Feb. 28, 2018 issued in co-pending related U.S. Appl. No. 14/510,599.
U.S. Office Action issued in U.S. Appl. No. 14/505,190 dated Dec. 22, 2017.
U.S. Office Action issued in U.S. Appl. No. 14/510,340 dated Feb. 7, 2018.
U.S. Office Action issued in U.S. Appl. No. 14/508,161 dated Feb. 9, 2018.

* cited by examiner

INDOOR DEVICE FOR CASSETTE TYPE AIR CONDITIONER

CROSS-REFERENCE TO RELATED APPLICATION(S)

The present application claims priority under 35 U.S.C. 119 and 35 U.S.C. 365 to Korean Patent Application No. 10-2013-0117925, filed in Korea on Oct. 2, 2013, which is hereby incorporated by reference in its entirety.

BACKGROUND

Field

An indoor device for a cassette type air conditioner is disclosed herein.

Background

In general, air conditioners are cooling/heating systems in which indoor air is suctioned in and heat-exchanged with a low or high-temperature refrigerant, and then the heat-exchanged air is discharged into an indoor space to cool or heat the indoor space. The above-described processes are repeatedly performed. Air conditioners may generate a series of cycles using a compressor, condenser, an expansion valve, and an evaporator.

In particular, such an air conditioner may include an outdoor unit or device (which is called an "outdoor side" or "heat dissipation side"), which is generally installed in an outdoor space and an indoor unit or device (which is called an "indoor side" or "heat absorption side"), which is generally installed in a building. The outdoor device may include a condenser, that is, an outdoor heat exchanger, and a compressor, and the indoor device, that is, an indoor heat exchanger, may include an evaporator.

As is well known, air conditioners may be divided into split type air conditioners with outdoor and device, which that are installed separately from each other, and integrated type air conditioners with outdoor and indoor device, which are integrally installed with each other. When considering a space in which an air conditioner is to be installed or noise, split type air conditioner may be preferable.

In a multi air conditioner of such a split type air conditioner, a plurality of indoor devices may bee connected to one outdoor device. Thus as the plurality of indoor devices may be respectively installed in indoor spaces for air-conditioning, an effect as if a plurality of air conditioners are installed may be achieved.

Hereinafter, an indoor device for a cassette type air conditioner in a general multi type air conditioner will be described with reference to the accompanying drawing.

FIG. 1 is a perspective view illustrating an exterior of an indoor device for a cassette type air conditioner according to the related art. As illustrated in FIG. 1, an indoor unit or device 1 may be maintained in a state in which an upper portion of the indoor device 1 is fixed to an inside of a ceiling and hung on the ceiling, and a bottom surface is exposed to a lower side of the ceiling to suction indoor air and then to discharge the suctioned air into the indoor space. In the indoor device 1, as most of the main body is disposed in the ceiling, only a panel 10 and suction grill 20 may be shown when a user looks up toward the ceiling.

The panel 10 may define an exterior edge of the bottom surface of the indoor device 1. A suction hole 11, which may be provided in a square shape, may be defined in a central portion of the panel 10 to guide introduction of the indoor air into the indoor device 1. A plurality of discharge holes 12, which may be provided to guide the air so that the air conditioned in the indoor device 1 may be discharged again into the indoor space, may be defined outside of the suction hole 11. A vane 13 to adjust a flow direction of the discharged air may be rotatably disposed in each discharge hole 12.

The suction grill 20, which may have an approximately square plate shape and in which a plurality of hole through which air passes may be defined may be mounted on the central portion of the front panel 10, that is, inside the suction hole 11. The suction grill 20 may be configured to filter foreign substances contained in the air introduced into the indoor device 1 through the suction hole 11. The suction grill 20 may have a size and shape that corresponds to a size and shape of the suction hole 11.

An air filter 30 may be disposed above the suction grill 20. The air filter 30 may be separably mounted on the suction grill 20 so as to provide for easy cleaning where foreign substances collect on the air filter 30 when the indoor device 1 is used for a long period of time. Also, the suction grill 20 may be selectively opened so that the air filter 30 may be easily separated therefrom.

That is, the suction grill 20 may be rotatably coupled to an end or edge of the panel 10. In more detail, a first end of the suction grill 20 and an inner surface of the suction hole 11 may be coupled to each other by a hinge 21. The suction grill 21 may rotate downward with respect to the hinge 21 to selectively open an inside of the indoor device 1, as illustrated in FIG. 1.

A switching button 14, which may be manipulated by a user when the suction grill 20 is opened or closed, may be disposed on a surface of the front panel 10. The switching button 14 may interfere with a second end of the suction grill 20 by an elastic restoring force thereof to prevent the suction grill 20 from rotating. When the switching button 14 is pushed, the interference with the second end of the suction grill 20 may be released, and thus, the suction grill 20 may rotatable with respect to the hinge 21.

As described above, the suction grill 20 may have a structure in which the first and second ends of the suction grill 20 are supported by the switching button 14 and the hinge 21. Thus, the suction grill 20 may be restricted in a closed state.

In the indoor device 1 having the above-described structure according to the related art, when the indoor device 1 increases in size, the suction grill 20 may also increase in size. In this case, if only the first and second ends of the suction grill 20 are supported, sides of the suction grill 20 may droop down. Also, even if the indoor device 1 itself is not changed in size, when the suction grill 20 further increases in size, the above-described limitation may occur.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
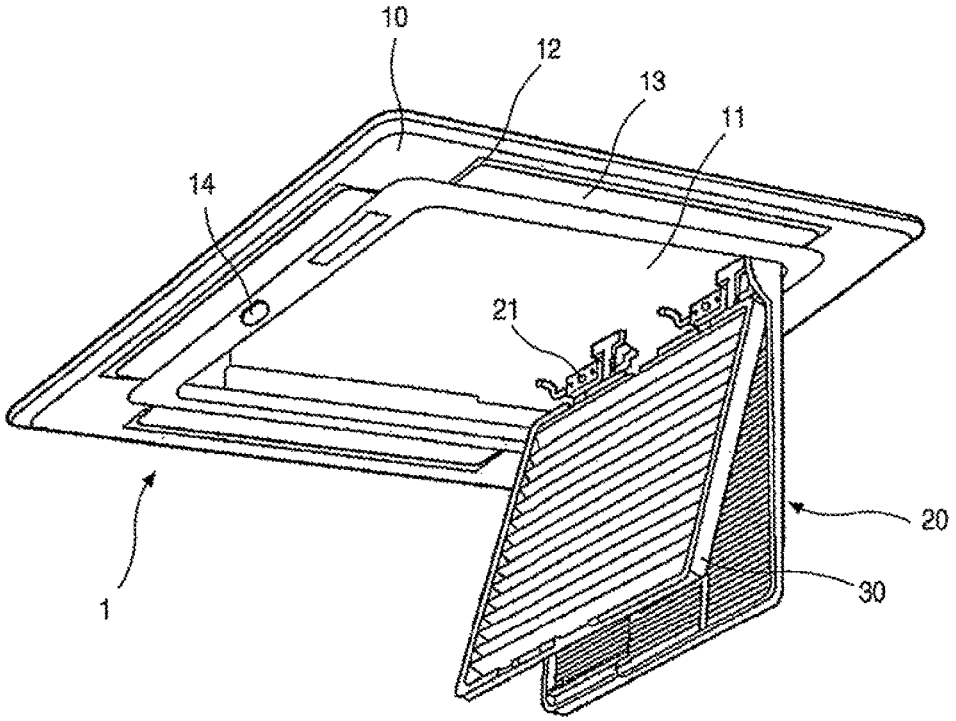
Fig. 1 Related Art
FIG. 1 is a perspective view of an indoor device for a cassette type air conditioner according to a related art.
Figure 2:
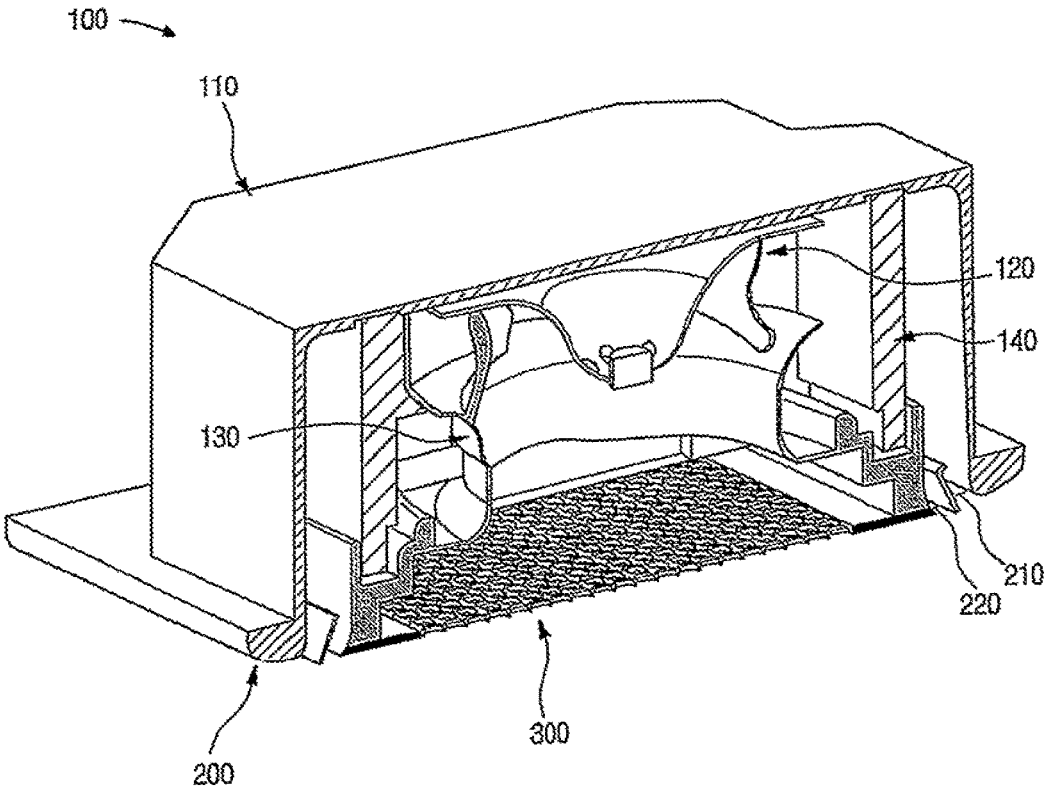
FIG. 2 is a schematic cutoff perspective view of an indoor device for a cassette type air conditioner according to an embodiment.

FIG. 2 is a schematic cutoff perspective view of an indoor device for cassette type air conditioner according to an embodiment. Referring to FIG. 2, an indoor unit or device 100 for an air conditioner (hereinafter, referred to as an "indoor device") according to embodiments may include a cabinet 110 inserted into a ceiling in an indoor space, and a panel 200 and suction grill 300, which may be disposed on a lower end of the cabinet 110 to define an exterior of a bottom surface of the indoor device 100 and may be exposed in the ceiling when the indoor device 100 is installed. A heat exchanger 140 that heat-exchanges with suctioned air, a blower fan 120 to forcibly suction in and discharge indoor air, and an air guide 130 having a bellmouth shape to guide the suctioned air toward the blower fan 120 may be provided in the cabinet 110.

The panel 200 may be mounted on the lower end of the cabinet 110 and have an approximately rectangular shape when viewed from a lower side thereof. Also, the panel 200 may protrude outward from the lower end of the cabinet 110 so that a circumferential portion of the panel 200 may be in contact with the ceiling.

At least one discharge hole 210 that serves as an outlet, through which the air may be discharged from the cabinet 110, may be provided in the panel 200. A discharge hole 210 may be defined at a position corresponding to each side of the panel 200. Each discharge hole 210 may be defined along a longitudinal direction of each side of the panel 200. Each discharge hole 210 may be opened or closed by a vane 220 mounted on the panel 200.

The suction grill 300 may be mounted on or at a central portion of the panel 200. The suction grill 300 may define an exterior of a bottom surface of the indoor device 100. The suction grill 300 may provide a passage for air introduced into the indoor device 100. At least a portion of the suction grill 300 may have a grill or lattice shape so that the indoor air may be smoothly introduced.

Hereinafter, structures of the panel 200 and the suction grill 300 according to embodiments will be discussed in detail hereinbelow.

Figure 3:
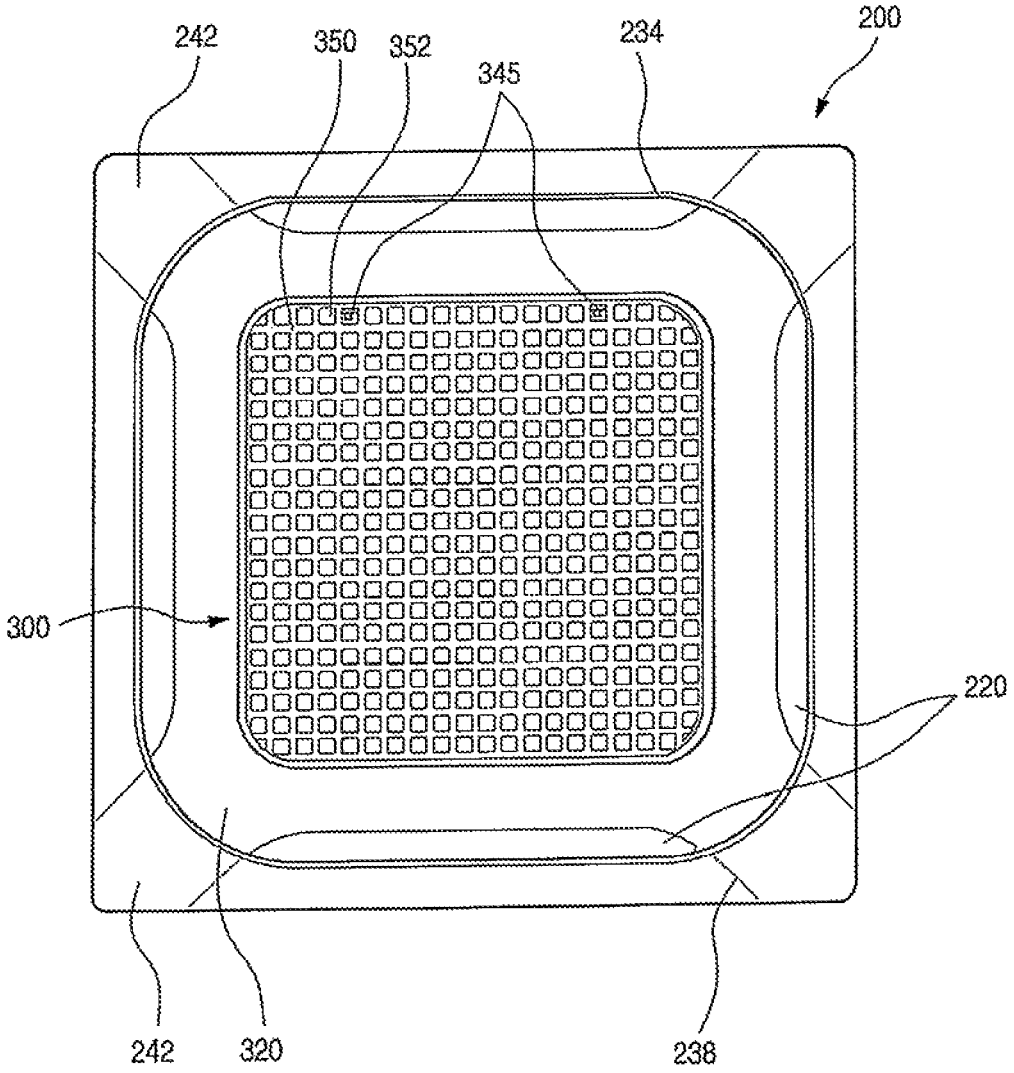
FIG. 3 is a bottom view of the indoor device for a cassette type air conditioner of FIG. 2.
Figure 4:
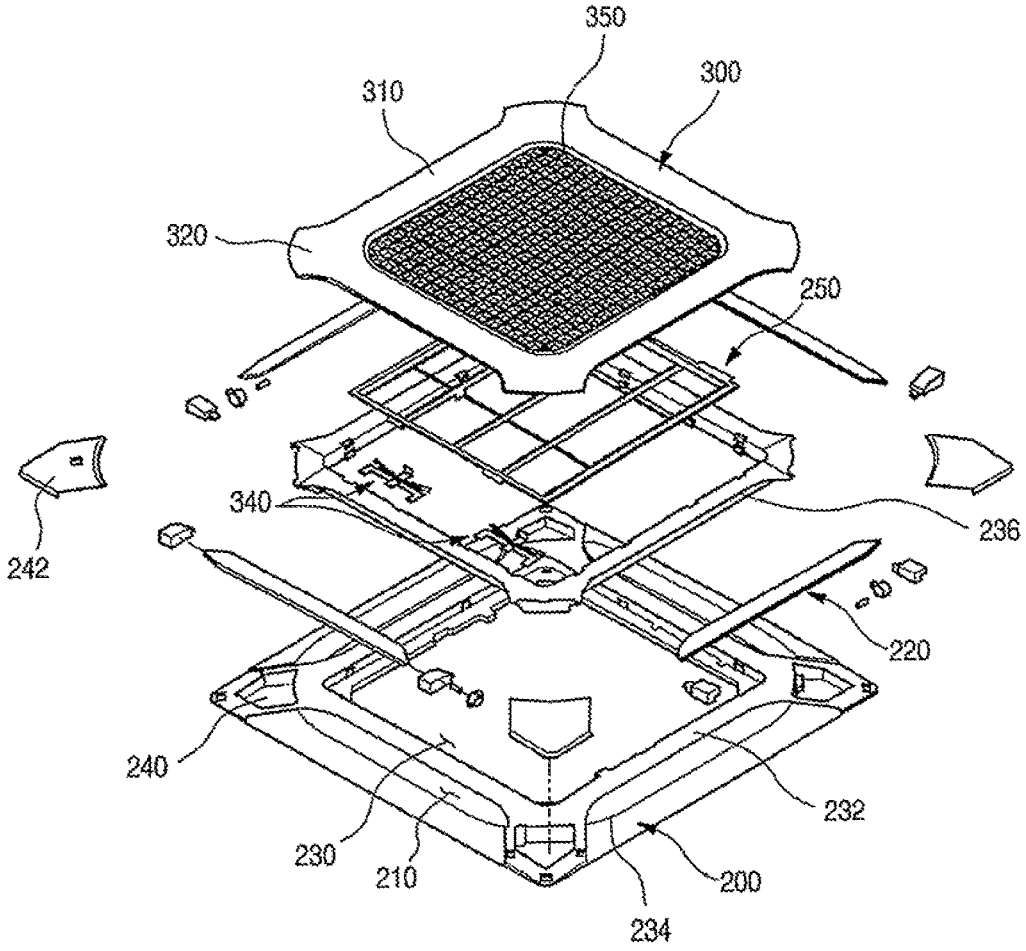
FIG. 4 is an exploded perspective view illustrating a main portion of the indoor device for a cassette type air conditioner of FIG. 2.
Figure 5:
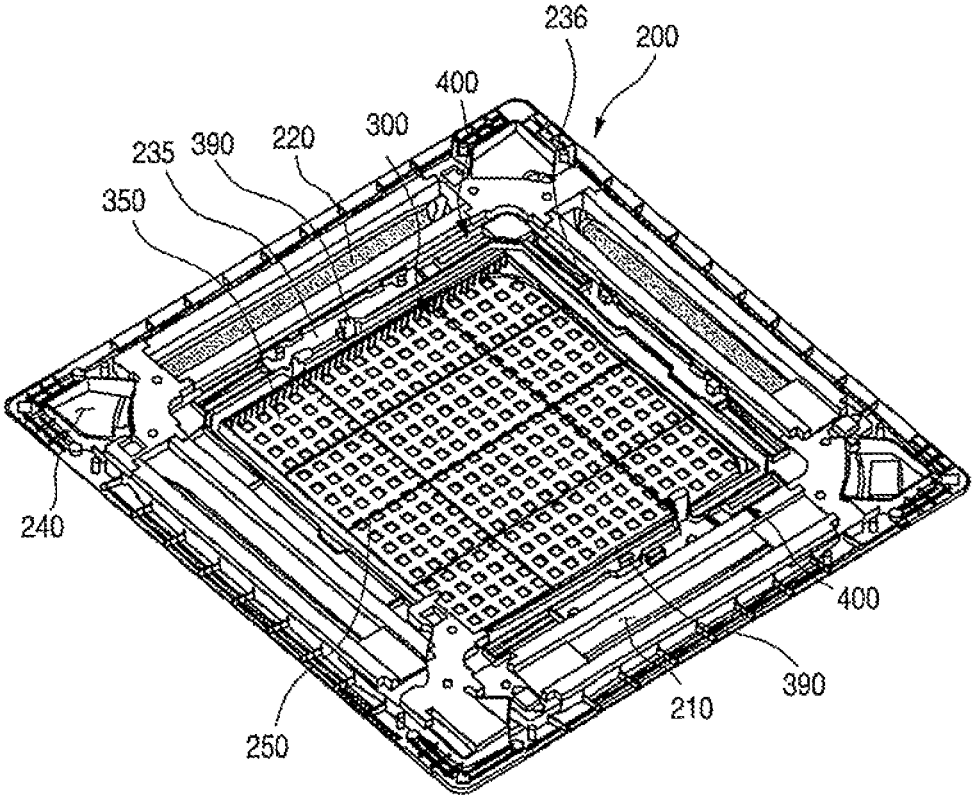
FIG. 5 is a view illustrating a state in which a panel and a suction grill of the indoor device for a cassette type air conditioner of FIG. 2 are coupled to each other according to embodiments.
Figure 6:
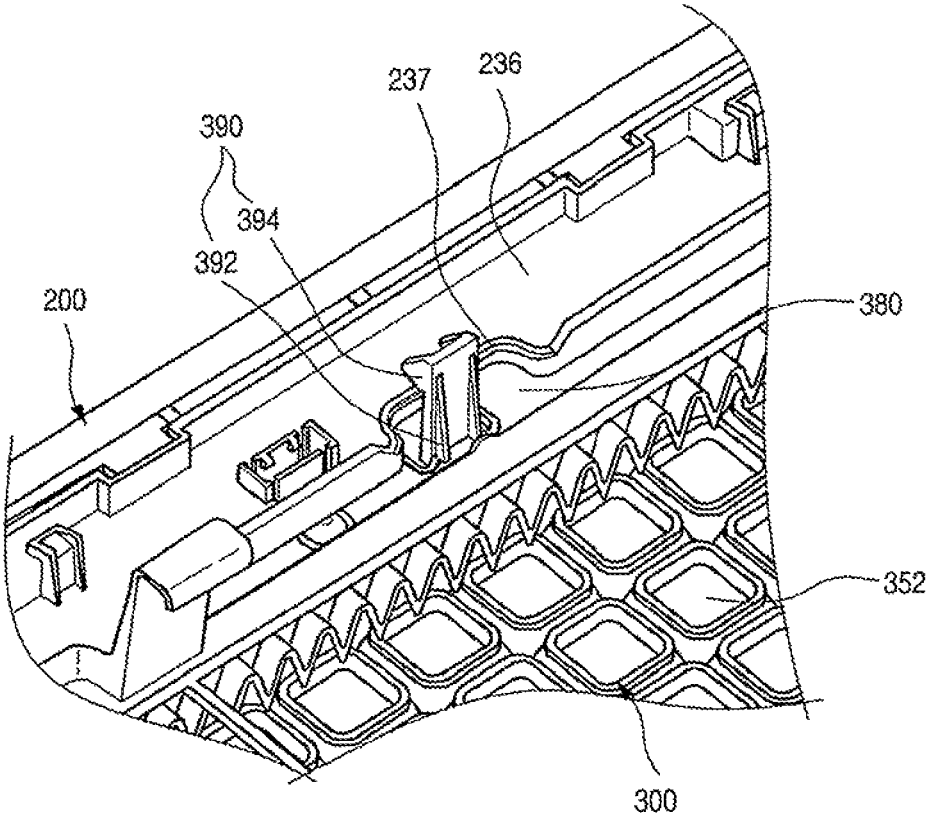
FIG. 6 is a partial enlarged view illustrating a state in which a coupling member of the indoor device for a cassette type air conditioner of FIG. 2 is coupled.
Figure 7:
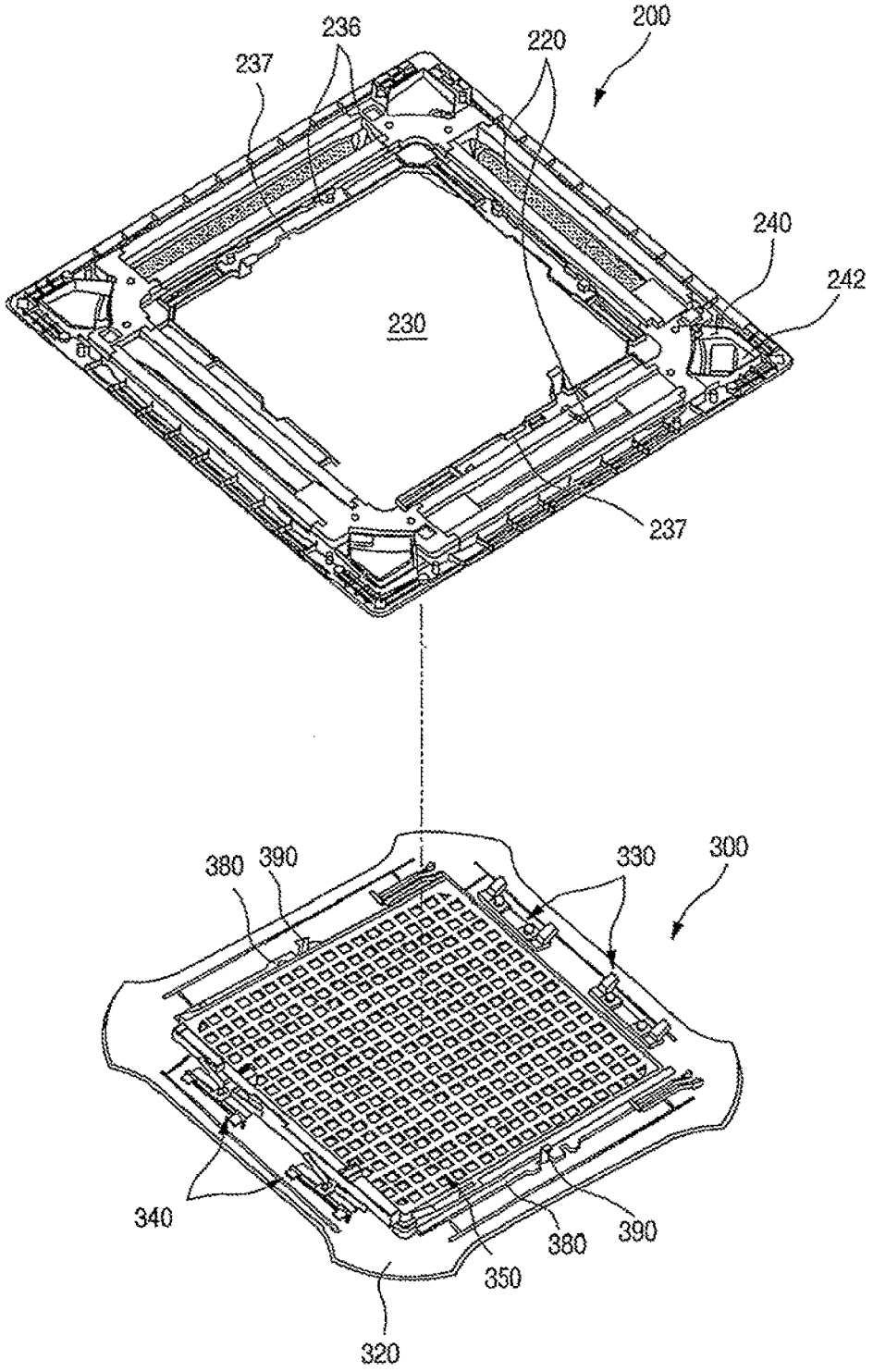
FIG. 7 is a view illustrating a state in which the panel and the suction grill of the indoor device for a cassette type air conditioner of FIG. 2 are separated from each other.

FIG. 3 is a bottom view of the indoor device for a cassette type air conditioner of FIG. 2. FIG. 4 is an exploded perspective view of a main portion of the indoor device for a cassette type air conditioner of FIG. 2. FIG. 5 is a view illustrating a state in which the panel and the suction grill of the indoor device for a cassette type air conditioner of FIG. 2 are coupled to each other. FIG. 6 is a partial enlarged view illustrating of a state in which a coupling member of the indoor device for a cassette type air conditioner of FIG. 2 is coupled. FIG. 7 is a view illustrating a state in which the panel and the suction grill of the indoor device for a cassette type air conditioner of FIG. 2 are separated from each other.

As illustrated in FIG. 2, the panel 200 may have an approximately rectangular plate shape. A suction hole 230 may be provided in a central portion of the panel 200. The suction hole 230 may be configured to suction in the indoor air. The suction hole 230 may have a square shape and a size slightly less than a size of the suction grill 300.

The discharge hole(s) 210 may be defined outside of the suction hole 230. The discharge hole(s) 210 may be provided in each of four sides. Both ends of each discharge hole 210 may have a curve shape having a width that gradually decreases towards ends thereof.

A grill seat 232 may be disposed outside of the suction hole 230. The grill seat 232 may be stepped to support the suction grill 300. A panel-side mount 260, on which a connection member 400 that will be discussed hereinbelow may be mounted may be disposed on the grill seat 232.

A circumference of the grill seat 232 may have a close loop shape that generally defines an outer line of each discharge hole 210. A rounded groove 234 may be defined around the grill seat 232 in a state in which the suction grill 300 is mounted. The rounded groove 234 may have a square shape having four rounded edges. Also, the four rounded edges of the rounded groove 234 may define a line corresponding to an outer line of the suction grill 300, so that vanes 220 of the discharge hole(s) 210, the suction grill 300, and the panel 200 may provide a sense of unity on the whole. Also, the rounded groove 234 may have a predetermined rounded or inclined section so that discharged air does not flow along the panel 200, thereby preventing the ceiling from being wetted or contaminated by air discharged from the discharge hole(s) 210.

The discharge hole(s) 210 may be opened or closed by the vane(s) 220. A motor may be disposed on an end of each vane 220. Thus, the vane 220 may be rotated by the motor to adjust a flow direction of the discharged air.

Each vane 220 may have a shape corresponding to a shape of a respective discharge hole 210 to cover the discharge hole 210. Also, each of the vane 220 may have a width that gradually decreases towards ends thereof, similar to the discharge hole 210. When the vane 220 is closed, an outer edge of the vane 220 may extend along the rounded groove 234 to contact the panel 200, and an inner edge of the vane 220 may contact a concave portion 310 of the suction grill 360.

An inspection hole 240 may be formed in each of the four edges of the panel 200. The inspection hole 240 may provide a space to fix and install the panel 200. The inspection hole 240 may be opened or closed by a corner cover 242 so as to receive service to electric components mounted on a back surface of the panel 200 or confirm an operation of the indoor device 100. An inspection hole 240 and a corner cover 242 may be disposed on each of the four edges of the panel 200 or be disposed on at least one of the four edges.

An end of the corner cover 242 may be disposed to face an end of protrusion 320 of the suction grill 300 with respect to a boundary of the rounded groove 234. Each corner cover 242 and protrusion 320 may have lines corresponding to the rounded groove 234 to provide a three-dimensional effect on the whole.

A separate panel bracket 236 may be mounted on the grill seat 232 of the panel 200. The panel bracket 236 may be configured to reinforce the grill seat 232 and stably support components to mount or open/close the suction grill 300 mounted on the grill seat 232. Alternatively, the panel bracket 236 may not be provided, but rather, the grill seat 232 and the panel bracket 236 may be integrated with each other to allow the grill seat 232 to perform the function of the panel bracket 236.

The panel bracket 236 may have a square frame shape. Also, a central portion of the panel bracket 236 may be opened in a shape corresponding to a shape of the suction hole 230. The panel bracket 236 may be fixed so that a switching member 340 and a fixing member 330, which will be described hereinbelow, may be hooked in a state in which the panel bracket 236 is mounted on the panel 200 to maintain a closed state of the suction grill 300.

Thus, the panel bracket 236 may be formed of a material having a high strength to prevent the panel bracket 236 from being deformed or damaged. The panel bracket 236 may be formed of a material different from that of the panel 200. For example, the panel bracket 236 may be formed of a metal material and mounted on an inner side surface of the panel 200.

A coupling portion 237, to which a suction grill restricter 390 may be coupled, may be disposed on each of both sides of the panel bracket 236. When the switching member 340 and the fixing member 330 are restricted on front and rear ends of the panel 200, the coupling portion 237 and the suction grill restrictor 390 may be disposed on both lateral sides of the panel bracket 236 so that the suction grill 300 may be fixed in four directions by the switching member 340, the fixing member 330, and the suction grill restricter 390.

Further, the suction grill restricter 390 may be disposed at a center of the suction grill 300 in a front to rear direction so that both ends of the suction grill 300 do not droop down, but rather, are fixed in a state in which the suction grill restricter 390 is coupled to the panel bracket 236. That is, front and rear ends of the suction grill 300 may be maintained in a fixed state by the switching member 340 and the fixing member 330, and both ends of the suction grill 300 may be fixed by the suction grill restricter 390.

When the panel bracket 236 is not provided as a separate member, but rather, is integrated while the panel 200 is manufactured, each of the switching member 340, the fixing member 330, and the suction grill restrictor 390 may be coupled to the panel 200 to correspond to the panel 200. Also, in some cases, at least one of the switching member 340, the fixing member 330, or the suction grill restrictor 390 may be restricted with the panel bracket 236, and the rest may be restricted with the panel 200.

The suction grill 300 may be mounted on the grill seat 232. In a state in which the suction grill 300 is mounted, a bottom surface of the panel 200 and a bottom surface of the suction grill 300 may be disposed on a same plane to provide a sense of unity.

The concave portion 310 may be defined in each of the sides of the suction grill 300. The concave portion 310 may be disposed at a same position as an inner line of the discharge hole 210. Also, in the state in which the suction grill 300 is mounted, an inner line of the discharge hole 210 and the concave portion 310 may have a same shape. That is, the concave portion 310 may have rounded ends or edges. The concave portion 310 may have a curvature corresponding to the shapes of the discharge hole 210 and the vane 220.

Thus, if the suction grill 300 is closed, an inner line of the vane 220 and an end or edge of the suction grill 300 may be adjacent to each other at the same distance. Thus, the suction grill 300 and the panel 200 may provide a sense of unity.

The protrusion 320 may be disposed on each of the four edges of the suction grill 300. Each protrusion 320 may further protrude from the concave portion 310 to define a region between the concave portions 310. Each protrusion 320 may be disposed between the discharge holes 210 when the suction grill 300 is mounted. Each protrusion 320 may have an end that is rounded at a same curvature as that of the rounded groove 234. Thus, in a state in which the suction grill 300 is mounted, a circumference defined by the suction grill 300 and the vane 220 may have a same shape as the rounded groove 234.

The protrusion 320 may have a same width as the corner cover 242. A side groove 238 defined along the protrusion 320 may extend up to an end or edge of the panel 200 along both sides of the corner cover 242. Also, the side groove 238 may be connected to the concave portion 310 of the suction grill 300 and the inner line of the vane 220.

Thus, in a state in which the indoor device 100 is installed, when viewed from a lower side of the indoor device 100, the rounded grooves 234 may be defined in a center, and the side groove 238 may be defined in each of four sides. Also, the shapes of the suction grill 300, the discharge hole 210, and the vane 220 may be defined by the rounded groove 234 and the side grooves 238.

Hereinafter, a structure of an inner side surface, that is, a top surface of the suction grill will be described in more detail.

Figure 8:
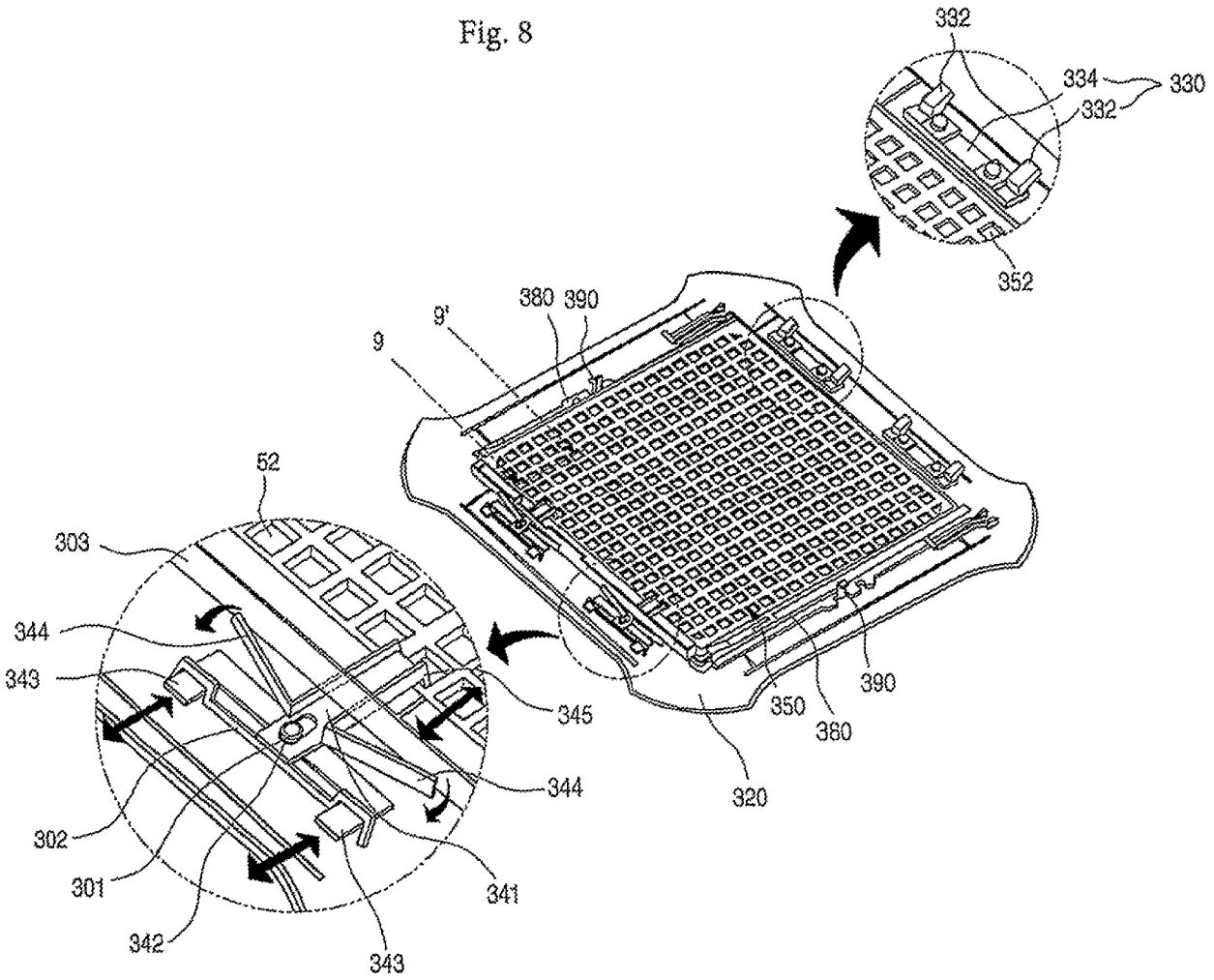
FIG. 8 is a perspective view illustrating an inner side surface of the suction grill according to embodiments.

FIG. 8 is a perspective view illustrating an inner side surface of the suction grill according to embodiments. As illustrated in FIG. 8, a grill-side mount 370, on which the connection member 400 may be mounted, may be disposed on each of both lateral sides of a top surface of the suction grill 300. The grill-side mount 370 may be disposed outside of a suction portion 350, which will be described hereinbelow. That is, a pair of ribs may extend upward from the grill-side mount 370 to allow the connection member 400 to be rotatably fixed thereto.

A fixing member 330 to fix the suction grill 300 and a switching member 340 to selectively restrict the suction grill 300 may be disposed on front and rear ends of a top surface of the suction grill 300, respectively. Each fixing member 330 may be mounted on or at a rear side of the suction grill 300 as a separate member. Each fixing member 330 may include a pair of protruding fixed pieces 332 to be fixed to the panel 200 or the panel bracket 236, and a coupling plate 334 to connect the pair of fixed pieces 332 to each other and to the suction grill 300. The pair of fixed pieces 332 may be inclined upward. Thus, when the suction grill 300 is pushed backward, the fixed pieces 332 may be inserted into one side of the panel 200 to fix a rear end of the suction grill 300 to the panel 200. On the other hand, when the suction grill 300 is pulled forward, the rear end of the suction grill 300 may be separated from the panel 200. A pair of the fixing members 330 may be provided at both lateral sides of the suction grill 300. The fixing members 330 may be integrated with the suction grill 300. Also, a fixing member insertion portion, in which the fixing member 330 may be inserted, may be defined in the panel 200 or the panel bracket 236 to correspond to each fixing member 330.

Each switching member 340 may be restricted against the panel 200 or the panel bracket 236 so that a front end of the suction grill 300 may be fixed in a state in which the fixing member 330 is inserted into the panel 200 or the panel bracket 236. That is, the switching member 340 may be selectively restricted according to a user's manipulation.

In more detail, each switching member 340 may be disposed on a front portion of the suction grill 300. Also, a pair of switching members 340 may be provided with a distance therebetween that corresponds to the fixing member 330. Also, each switching member 340 may be configured to selectively restrict the panel 200 and the suction grill 300 by elasticity when manipulated by a user. Each switching member 340 may be configured to be manipulated by a user when the suction grill 300 is separated or mounted. Each switching member 340 may have one side exposed to a bottom surface of the suction grill 300 so as to be manipulated. The elasticity to operate the switching member 340 may be provided by the switching member 340 itself or a separate elastic member.

According to this embodiment, the switching member 340 may include a fixed portion 341 fixed to the suction grill 300, a manipulation portion 345 that extends from the fixed portion 342 to move the fixed portion 341 by a user's manipulation, and a plate-shaped elastic part 344 that extends to each of both sides of the manipulation portion 345 to provide an elastic force when the manipulation portion 345 is manipulated. A guide hole 342 having a long hole shape may be defined in a center of the fixed portion 341. A guide protrusion 301 that protrudes from the suction grill 300 may be inserted into the guide hole 342. Thus, the fixed portion 341 may be moved in forward and backward directions by the guide protrusion 301 and the guide hole 342. An insertion piece 343 that extends in a direction opposite to an extending direction of the manipulation portion 345 may be disposed on each of first and second ends of the fixed portion 341. The insertion piece 343 may be inserted into the panel 200 or the panel bracket 236 when the fixed portion 341 moves to maintain a state in which the suction grill 300 is restricted and mounted on the suction grill 300 and the panel 200 by the switching member 340.

An insertion piece guide 302 to guide movement of the insertion piece 343 may be disposed on the suction grill 300. The insertion piece 343 may pass through the insertion piece guide 302 provided on the suction grill 300. When the insertion piece 343 is restricted with the panel 200 or the panel bracket 236, the insertion piece guide 302 may support the insertion piece 343.

Thus, in a state in which the suction grill 300 is mounted, an end of the insertion piece 343 may pass through the insertion piece guide 302 and then be hooked and restricted by the panel 200 or the panel bracket 236 so that the suction grill 300 may be fixed in a closed state. The insertion piece guide 302 may guide movement of the insertion piece 343 so that the insertion piece 343 moves in an accurate direction as well as prevents the insertion piece 343 from drooping down.

The elastic portion 344 may have a plate shape, which may be inclined or curved in a backward direction and extend to both lateral sides. The elastic portion 344 may contact a support wall 303 that protrudes from the upper surface of the suction grill 300. Thus, the fixed portion 341 may be maintained in a state in which it moves in a forward direction when the manipulation portion 345 is not manipulated. Also, the insertion piece 343 may be restricted with the panel 200 or the panel bracket 236, and thus, the suction grill 300 may be maintained in a mounted state thereof. Also, when the manipulation portion 345 is manipulated and pulled, the elastic portion 344 may be elastically deformed, and the fixed portion 341 may be moved in a backward direction. As a result, restriction of the insertion piece 343 may be released to open the suction grill 300.

The manipulation portion 345 may pass through the support wall 303 and then be bent at an end of the fixed portion 341. The manipulation portion 345 may have an end that passes through the suction grill 300 and may be exposed to the outside so that a user may manipulate the manipulation portion 345. The manipulation portion 345 may be exposed between the plurality of grills 360 of the suction grill 300. In this case, a user may insert a finger thereof into a suction hole 352 between the plurality of grills 360 to manipulate the manipulation portion 345.

The suction grill restrictor 390 may be disposed on each of both sides of the suction hole 230. The suction grill restrictor 390 may have a hook shape. When the suction grill 300 is mounted, the suction grill restrictor 390 may be disposed at a position such that the suction grill restrictor 390 may be coupled to the coupling portion 237 disposed on the panel bracket 236.

In more detail, the suction grill restrictor 390 may be disposed on a filter guide 380 provided on each of both sides of the suction hole 230. The filter guide 380 may extend in forward and rearward directions. The filter guide 380 may be configured to mount a filter case 250 or an air filter on the upper surface of the suction grill 300. The filter guide 380 may be provided as a separate member, and then, may be mounted on the suction grill 300. Further, the filter guide 380 may be configured so that the filter case 250 or the air filter may be slidably coupled or detachably coupled thereto. For this, the filter case 250 may be slidably inserted into or vertically coupled to inner side surfaces of a pair of filter guides 380.

The suction grill restrictor 390 may protrude upward from a central portion of the filter guide 380. That is, the suction grill restrictor 390 may be disposed at a center in a front to rear direction to restrict central portions of both sides of the suction grill 300 when coupled to the coupling portion 237 to prevent the suction grill 300 from drooping down, thereby stably supporting the suction grill 300.

Also, the suction grill restrictor 390 may include an extension 392 that extends upward from the filter guide 380, and a hook 394 having a hook shape and disposed on an end of the extension 392. The hook 394 may be hooked with the coupling portion 237, which may be recessed outward in a state in which the suction grill 300 is mounted. In more detail, when the suction grill 300 is mounted, a top surface of the hook 394 may be inclined. Thus, when the suction grill restrictor 390 moves downward from an upper side, the coupling portion 237 and an inclined surface of the hook 394 may contact each other, and the extension 392 may be deformed inwardly. Then, when the inclined surface of the hook 394 passes through the coupling portion 237, the hook 394 may be hooked with the coupling portion 237.

An air filter (not shown) to purify air may be disposed above upper surface of the suction grill 300. The air filter may be detachably mounted on or to the filter case 250.

The air filter to filter foreign substances and physically or chemically purify suctioned air may be disposed within the filter case 250. The air filter may be separated from the filter case 250, and then, may be replaced after a predetermined time or usable time has elapsed.

A suction portion 350, which may have a lattice shape, may be disposed on or at the center of the suction grill 300. The suction portion 350 may be disposed inside the suction hole 230 of the panel 200 to allow the suctioned air to fully flow into the cabinet 111 through the panel 200.

Hereinafter, a specific shape of the suction portion 350 will be described with reference to the drawings.

Figure 9:
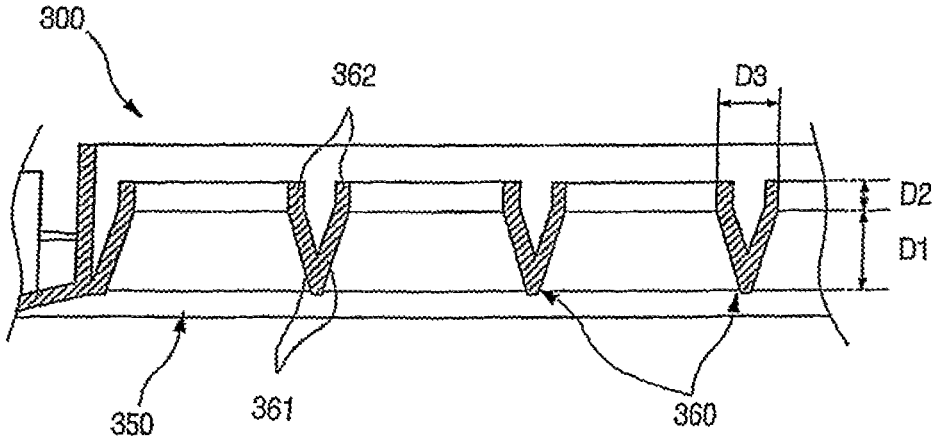
FIG. 9 is a partial cross-sectional view of the suction grill of FIG. 8, taken along line IX-IX' of FIG. 8.

FIG. 9 is a partial cross-sectional view illustrating the suction grill of FIG. 8, taken along line IX-IX' of FIG. 8. As illustrated in FIG. 9, the suction portion 350 of the suction grill 300 may have a lattice shape due to the plurality of grills 360, which may be disposed to cross each other in horizontal and vertical directions. Suction holes 352, through which air may be suctioned, may be successively defined between the plurality of grills 360.

As illustrated in the drawings, each of the plurality of grills 360 may have a cross-section having a shape that gradually decreases in width in a direction toward a bottom surface of the suction grill 300, with reference to FIG. 9. Thus, air suctioned through the suction holes 352 may smoothly flow upward without colliding with each other after passing through the plurality of grills 360. Each of the plurality of grills 360 may have a downwardly recessed shape with an opened top surface. Each grill 360 may have a predetermined space therein. Thus, dust or foreign substances generated above the suction grill 300 may drop and be collected into the space.

The structure of the grill will be described below in detail. The grill 360 may include an inclination portion 361 at a lower portion thereof and a vertical portion 362 that vertically extends upward from an upper end of the inclination portion 361. The inclination portion 361 may be tapered downward to form both inclined side surfaces. Thus, each suction hole 352 may have a wide lower end and a width that gradually decreases as it extends upward.

Also, the vertical portion 362 may extend upward in a direction substantially perpendicular to a bottom surface of the suction grill 300 from an upper end of the inclination portion 361. The inclination portion 361 may have a vertical length D1 less than a length D2 of the vertical portion 362. Also, the inclination portion 361 may have an angle so that the vertical portion 361 has an upper distance D3 greater by at least two times than the length D2 of the vertical portion 362 when comparing the upper end of the inclination portion 361, that is, a horizontal distance D3 of the vertical portion 362 to the horizontal length D2 of the vertical portion 361. Thus, the air passing through the suction hole 352 may be suctioned in a state in which the air is divided at the upper end of the suction holes 352. Thus, the air suctioned through the suction holes 352 may not cause noise due to collision as the air passes through the suction holes 352.

The suction grill 300 may be configured to open or close the panel 200 according to a user's manipulation. When the suction grill 300 is opened or closed, the suction grill 300 may be connected to the panel 200 by the connection member 400, which connects the suction grill 300 to the panel 200. Also, when the suction grill 300 is opened or closed by the connection member 400, the suction grill 300 may be slidably movable or rotatable.

Hereinafter, the connection member 400 and components to mount the connection member 400 will be described in detail hereinbelow.

Figure 10:
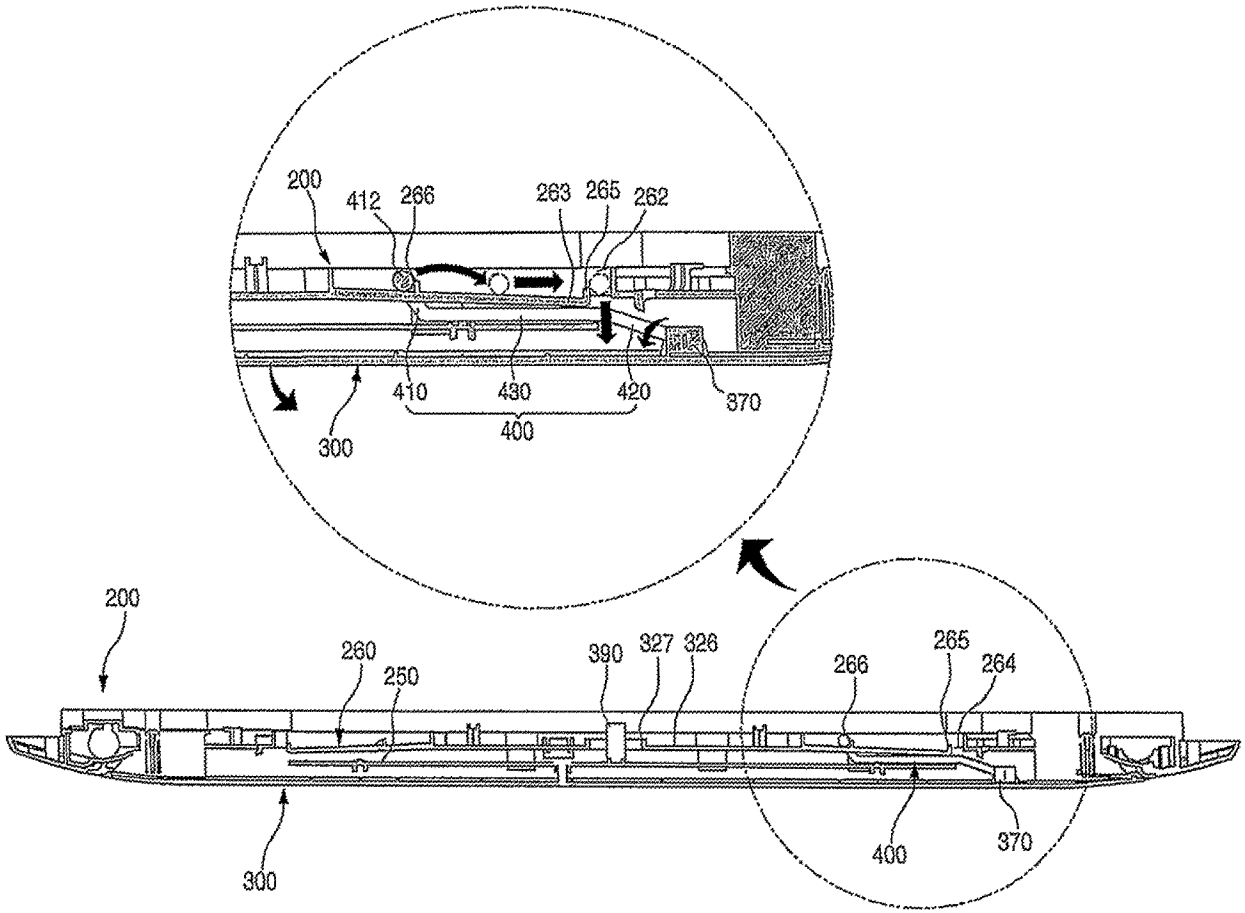
FIG. 10 is a cross-sectional view of the indoor device for a cassette type air conditioner according to embodiment.
Figure 11:
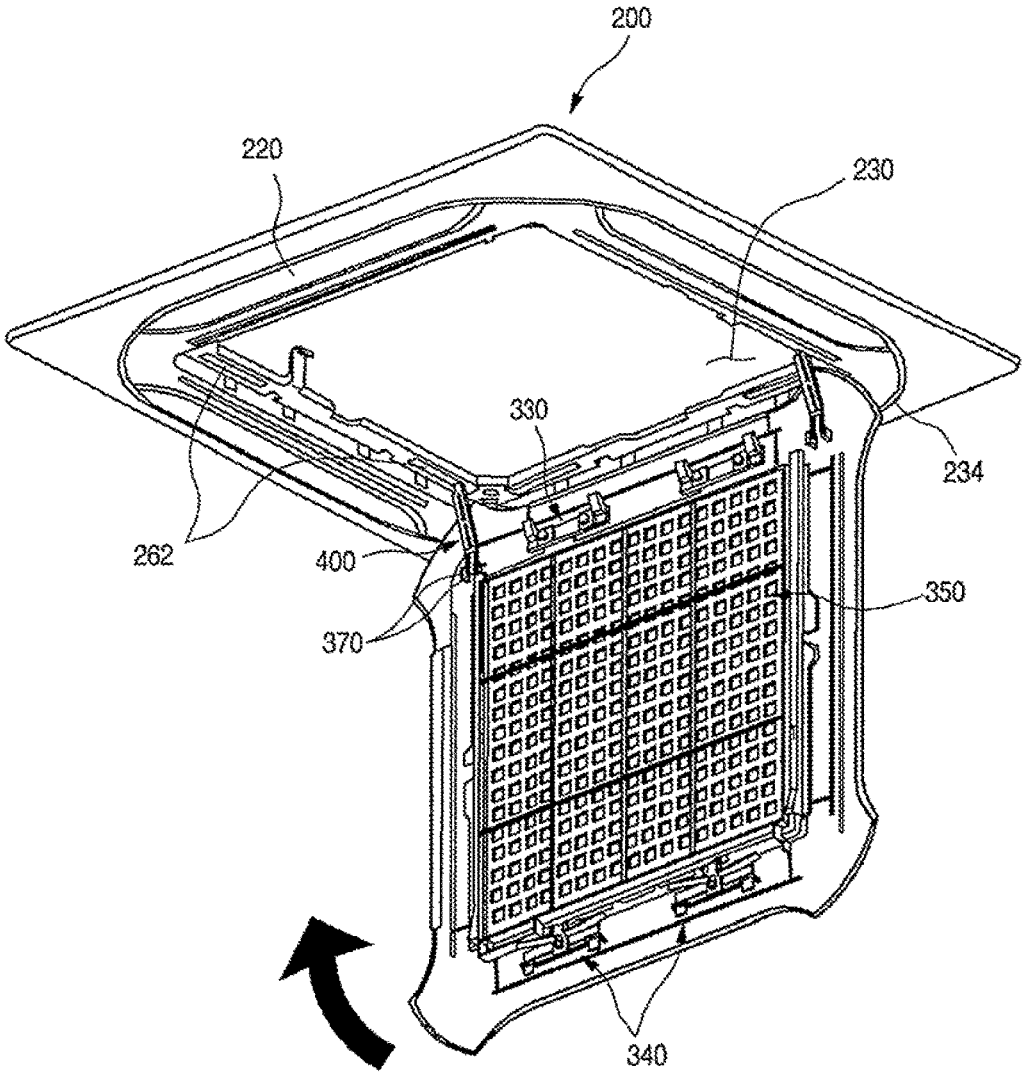
FIG. 11 is a perspective view illustrating a state in which the suction grill is opened according to embodiments.

FIG. 10 is a cross-sectional view of the indoor device for a cassette type air conditioner according to embodiments. FIG. 11 is a perspective view illustrating a state in which the suction grill is opened according to embodiments.

As illustrated in the drawings, the connection member 400 may have both ends respectively mounted on the panel 200 and the suction grill 300. A pair of the connection member 400 may be provided on or at both lateral sides to connect the suction grill 300 to the panel 200. For this, the grill-side mount 370 may be disposed on each of both lateral sides of the suction grill 300, and the panel-side mount 260 may be disposed on the panel 200.

The grill-side mount 370 may be coupled to a rotation coupling portion 422 disposed on a lower end of the connection member 400. The grill-side mount 370 may be provided as a pair of protruding plates so that the rotation coupling portion 422 may be rotatably coupled thereto. That is, the rotation coupling portion 422 may be inserted between the grill-side mounts 370. Both sides of the rotation coupling portion 422 may be rotatably coupled to the grill-side mount 370.

The panel-side mount 260 may be disposed on each of both lateral sides of the panel 200 so that an upper end of the connection member 400 may be mounted thereon. A plurality of panel-side mounts 260 may be provided so that the panel-side mounts 260 may be mounted regardless of a mounting direction of the suction grill 300. That is, the panel-side mount 260 may be disposed at a position spaced apart from each of both lateral sides of the panel 200. For example, four panel-side mounts 260 may be provided.

Thus, the mounting direction of the suction grill 300 may be selected to determine an opening direction of the suction grill 300. That is, when the connection member 400 is mounted on the panel-side mount 260 disposed on a front portion of the panel 200, the suction grill 300 may be opened while rotating using the front portion of the panel 200 as an axis. On the other hand, when the connection member 400 is mounted on the panel-side mount 250 disposed on a rear portion of the panel 200, the suction grill 300 may be opened while rotating using the rear portion of the panel 200 as an axis.

The panel-side mounts 260 disposed on the panel 200 may have a same fundamental structure and shape. Each panel-side mount 260 may include an edge to define a space in which the connection member 400 may be accommodated, a slot 262 inside the edge 261, and restricters 265 and 266 that protrudes from both lateral sides of the slot 262 to selectively restrict sliding movement of the connection member 400.

The edge 261 may extend upward to define a space in which an end of the connection member 400 may be accommodated and slidable. The edge 261 may have a rectangular shape. That is, the edge 261 may extend along one side of the grill seat 232.

The slot 262 may be defined in a space defined by the edge 261 and opened from a first end of the slot 262 up to a second end of the slot 262. The slot 262 may have a width less than a width of the upper end of the connection member 400. Thus, in a state in which the connection member 400 is inserted through the slot 262, the upper end of the connection member 400 may protrude from both sides of the slot 262.

A lower end of the slot 262 may have a width corresponding to an upper end of the connection member 400 or be opened to have an inner diameter greater than the width of the connection member 400 so that the connection member 400 may be inserted into the slot 262. Thus, when the connection member 400 is mounted, the upper end of the connection member 400 may be inserted through the lower end of the slot 262. In a state in which the connection member 400 is inserted into the slot 262, the connection member 400 may be movable along the slot 262.

A bottom surface 263 may be disposed on both lateral sides of the slot 262 to contact a contact 412 disposed on each of both lateral sides of the upper end of the connection member 400. The contact 412 may move along the bottom surface 263 when the connection member 400 moves. The bottom surface 263 may be inclined downward so that the contact 412 may be smoothly slidable in contact with the bottom surface 263.

A first restricter 265 may be disposed on an end of the slot 262. The first restricter 265 may protrude upward to prevent the connection member 400 as it moves along the slot 262 from being inserted into the end of the slot 262. That is, the first restricter 262 may protrude upward to prevent the contact 412 from moving toward the lower end of the slot 262.

A second restricter 266 may be further disposed on one side of the bottom surface 263. The second restricter 266 may protrude upward from the bottom surface 263 corresponding to the contact 412 in a state in which the suction grill 300 is closed. Thus, in the state in which the suction grill 300 is closed, movement of the contact 412 in a direction in which the suction grill 300 is opened may be restricted.

The second restricter 266 may have an inclined surface 267 so that the second restricter 266 has a height that gradually increases away from the first restricter 265. A vertical surface 268 that extends substantially perpendicular to the bottom surface 263 may be disposed on a highest end of the inclined surface 267.

Thus, when the suction grill 300 is closed, the contact 412 of the connection member 400 may move away from the first restricter 265. The contact 412 of the connection member 400 may slidably move over the inclined surface 267 of the second restricter 266. Also, in a state in which the suction grill 300 is fully closed, the contact 412 of the connection member 400 may contact the vertical surface 268 of the second restricter 266 to restrict random slidable movement of the connection member 40. The inclined surface 267 and the vertical surface 268 may be disposed so that they have surfaces that cross each other to more effectively perform sliding movement of the contact 412 and the restrict the contact 412.

The connection member 400 may have a bar shape having a predetermined length. The connection member 400 may have a sufficiently long length to maintain a sufficient distance so that the end of the suction grill 300 does not interfere with the panel 200 when the suction grill 300 is fully opened.

In detail, the connection member 400 may include an upper bent portion 410, a lower bent portion 420, and an intermediate connection portion 430. The upper bent portion 410 may be bent upward (when viewed in FIG. 10) with respect to the intermediate connection portion 430, the lower bent portion 420 may be bent downward in a direction opposite to the upper bent portion 410, and the intermediate connection portion 430 may connect the upper bent portion 410 to the lower bent portion 420. The upper bent portion 410 and the lower bent portion 420 may extend at an incline. The upper bent portion 410 may have an inclination greater than of the lower bent portion 420.

The contact 412 may be disposed on or at an upper end of the upper bent portion 410. The contact 412 may be disposed on both lateral sides of the upper end of the upper bent portion 410 to contact the bottom surface 263 of the panel-side mount 260. The contact 412 may have a roller shape, which is easily slidable. Further, the contact 412 may be rotatably mounted on the upper bent portion 410.

The contact 412 may be mounted to protrude from both sides of the upper bent portion 410 and have a width greater than a width of each of the upper bent portion 410, the intermediate connection portion 430, and the lower bent portion 420. Thus, when the connection member 400 slidably moves along the slot 262, the contact portion 412 may contact the bottom surface 263 of each of both sides of the slot 262.

The contact 412 may have a diameter greater than a height of the vertical surface 268 of the second restricter 266. Thus, when a user manipulates the suction grill 300 to open the suction grill 300, the contact part 412 may move over the vertical surface 268.

The lower bent portion 420 may extend to a lower end of the intermediate connection portion 430. That is, a pair of lateral sides of the lower bent portion 420 may extend so that central portions of the lower bent portion 420 may extend away from each other. Also, the rotation coupling portion 422 may be disposed on each of both sides of the lower end of the lower bent portion 420. The rotation coupling portion 422 may be rotatably shaft-coupled to the grill-side mount 370 disposed on the suction grill 300. Thus, when the suction grill 300 is opened, the suction grill 300 may be rotatable using the rotation coupling portion 422 as an axis.

Hereinafter, opening and closing processes of the suction grill of the indoor device for a cassette type air conditioner having the above-described structure according to embodiments will be described in detail with reference to the accompanying drawings.

As illustrated in the drawings, in a state in which the suction grill 300 is mounted on the panel 200 and then fully closed, the bottom surface of the suction grill 300 and a circumference of the bottom surface of the panel 200 may be disposed on a same plane so that the suction grill 300 and the panel 200 have a sense of unity.

Also, the connection member 400 may extend substantially parallel to the suction grill 300, and the contact 412 may be in contact with the vertical surface 268 of the second restricter 266. Thus, the contact 412 may be restricted in movement in one direction by the vertical surface 268.

In this state, the fixing member 330 mounted on the suction grill 300 may be inserted into the panel 200 or the panel bracket 236. Thus, a first end of the suction grill 300 may be fixed, and a second end of the suction grill 300 may be restricted with the panel 200 or the panel bracket 236 by the switching member 340. Also, the suction grill restrictor 390 may be fixed to the coupling portion 237 of the panel bracket 236 to restrict both ends of the suction grill 300.

Thus, the suction grill 300 may be maintained in a state in which the suction grill 300 is fixed and mounted on the panel 200. The suction grill 300 may be fixed in four directions, that is, four sides of the suction grill 300 may be fixed. Also, the switching member 340 of the fixing member 330 may be provided as a pair, and the suction grill restrictor 390 may be disposed at a center in the front to rear direction to prevent the suction grill 300 from drooping downward even though the suction grill 300 has a large size, thereby stably mounting the suction grill 300.

In this state, the indoor device 100 may operate to suction in the indoor air through the suction portion 350 of the suction grill 300. Then, the suctioned air may be heat-exchanged within the indoor device 100 and discharged into the indoor space through the discharge hole(s) 210.

During use of the indoor device 100, if internal service or cleaning of the indoor device 100 is required, or replacement of the air filter within the indoor device 100 is needed, the suction grill 300 will have to be opened. To open the suction grill 300, the switching member 340 may be manipulated first to allow restriction of the second end of the suction grill 300 to be released from the panel 200. The switching member 340 may be manipulated to release the restriction of the first end of the suction grill 300 and then pull the suction grill 300 downward. When the suction grill 300 is pulled downward, the suction grill restricter 390 may be separated from the coupling portion 237, and both ends of the suction grill 300 may also be separated from the panel 200.

Also, when the suction grill 300 is pulled forward to allow the contact 412 to move away from the second restricter 266, the suction grill 300 may slightly move forward to separate the fixing member 330 from the panel 200. That is, the restriction between the suction grill 300 and the panel 200 may be completely released, and thus, the suction grill 300 may be movable forward or backward.

In this state, when the suction grill 300 is pushed backward, the contact 412 may slidably move over the vertical surface 268 of the second restricter 266. Also, the contact 412 may be smoothly slidable along the inclination of the bottom surface 263. The contact 412 may be smoothly slidable to the first restricter 265 by a weight of the suction grill 300. Simultaneously, the suction grill 300 may be smoothly rotated and then be opened due to the position of the grill seat 232 disposed biased to one side of the suction grill 300.

As described above, the connection member 400 may slidably move to provide a sufficient gap between the panel 200 and the suction grill 300. Thus, when the suction grill 300 rotates to open, the suction grill 300 and the panel 200 may not interfere with each other.

More particularly, the protrusion 320 disposed on an edge of the suction grill 300 may cover the panel 200. However, the panel 200 and the suction grill 300 may be spaced apart from each other by movement of the connection member 400 as described above to open the suction grill 300 without interfering with the protrusion 320 even though the suction grill 300 rotates. Further, the suction grill 300 may smoothly slide and rotate just when the contact 412 of the connection member 400 is over the first restricter 265 by the coupling relationship between the connection member 400, the panel 200, and the suction grill 300.

In a state in which the suction grill 300 is fully opened, the front end of the suction grill faces a lower side, and thus, a back surface of the suction grill 300 may be fully exposed forward. Thus, internal cleaning and service operations of the indoor device 100 may be performed, and also, replacement of the air filter and the cleaning of the suction grill 300 may be easily performed.

In this state, a user may detach the suction grill 300 to separate the suction grill 300 from the panel 200. For this, the user may lift the suction grill 300 upward in a state in which the contact 412 is in contact with the first restricter 265 to allow the contact 412 to be withdrawn through the opened portion of the lower end of the slot 262 over the first restricter 262, thereby separating the connection member 400 from the panel-side mount 260.

To mount the suction grill 300 on the panel or open the suction grill 300, the above-described processes may be reversely performed to insert the connection member 400 into the panel-side mount 260. Then, the suction grill 300 may rotate and slide to allow the contact 412 to contact the vertical surface 268 of the second restricter 266. Also, the suction grill restricter 390 may be coupled to the coupling portion 237, and the fixing member 330 and the switching member 340 may restrict the panel 200 to maintain a state in which the suction grill 300 is closed.

In a state in which the suction grill 300 is fully closed, the front and rear ends and both lateral ends of the suction grill 300 may be restricted with the panel 200 to prevent each of the ends of the suction grill 300 from drooping downward, thereby maintaining a stably fixed state of the suction grill 300.

Hereinafter, suction and discharge states of air into and from the indoor device for a cassette type air conditioner including the above-described structure according to embodiments will be described.

Figure 12:
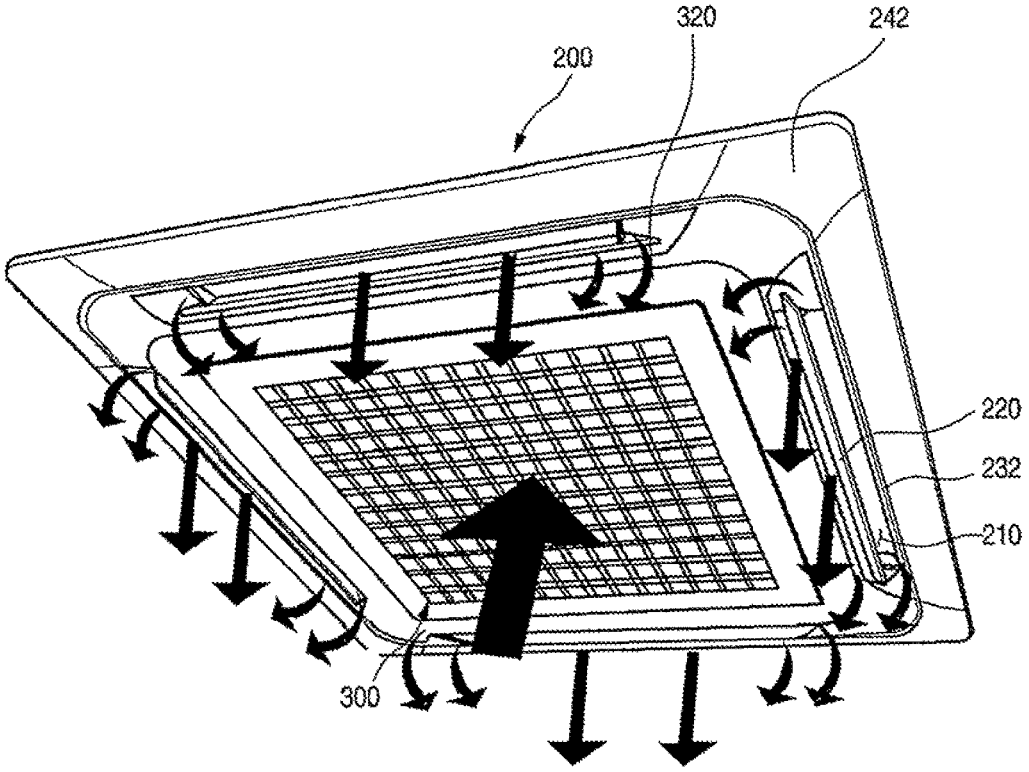
FIG. 12 is a schematic perspective view illustrating an air flow in the panel and the suction grill according to embodiments.
Figure 13:
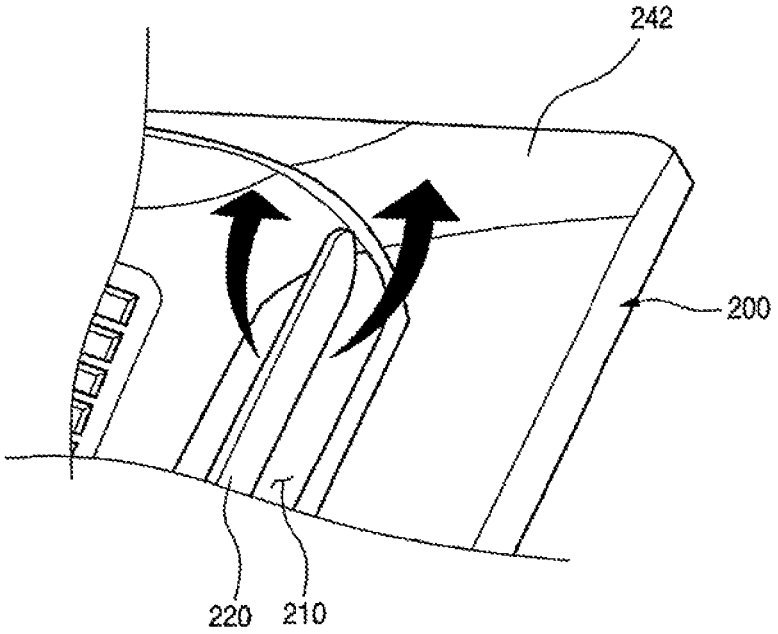
FIG. 13 is a partial perspective view of an air discharge structure in a discharge hole according to embodiments.

FIG. 12 is a schematic perspective view illustrating an air flow in the panel and the suction grill according to embodiments. FIG. 13 is a partial perspective view of an air discharge structure in a discharge hole according to embodiments.

As illustrated in the drawings, when the indoor device 100 operates, indoor air may be suctioned into the indoor device 100 through the suction grill 300. Also, the air may be heat-exchanged within the indoor device 100, and then discharged to the outside through the plurality of discharge holes 210.

When the vanes 220 disposed inside the discharge holes 210 rotate, discharged air may be directed in a flow direction according to a rotating direction of the vane 220. Thus, the air may be discharged outward from each of the discharge holes 210.

An outer line of the discharge hole(s) 210 may be defined by the rounded groove 234. The rounded groove 234 may have a rounded section. As illustrated in FIG. 15, the discharged air may not flow along an outer surface of the panel 200, but rather, be discharged into the indoor space. Thus, the discharged air may be supplied into the indoor space without contaminating the panel 200 outside of the discharge hole(s) 210 or the ceiling surface.

Both ends of each discharge hole 210 of the panel 200 may gradually decrease in width outward and be rounded to forma a tapered end of the panel 200. Also, a guide member defining an inner surface of the discharge hole 210 may be inclinedly disposed. More particularly, in a case of both ends of the discharge hole 210, the guide member may be rounded toward both ends of the discharge hole 210. Thus, discharged air may be concentrated as a flow of air discharged from both ends of the discharge hole 210 in a central direction to prevent dew condensation from occurring on ends of the discharge hole 210 and an end of the vane 220.

According to embodiments, a suction grill may be mounted to cover a panel. More particularly, the suction grill may extend up to discharge holes of the panel to form as inner line of the discharge holes, thereby providing an elegant exterior. Also, an outer line of the discharge holes and a protrusion of the suction grill may form one closed loop by the rounded groove to minimize lines generated by connected portions between components, thereby further providing an elegant exterior.

Further, the grill restriction member to fix the suction grill to the panel may be further provided to prevent a central portion of the suction grill having a large size from drooping downward. Thus, the suction grill y increase in size to more simplify the exterior of the indoor device.

Furthermore, the grill restriction member may prevent air from leaking between the suction grill and the panel. Thus, it may prevent dew condensation from occurring between gaps in the suction grill or the panel, and also prevent noise from occurring due to the introduction of the air into the gaps.

Also, as additional restriction between the suction grill and the panel is enabled by the switching member and the grill restriction member, when the switching member is manipulated, it may prevent the suction grill from drooping downward or rotating. Also, when the suction grill is closed, as the switching member may be manipulated in a state in which the suction grill may be primarily fixed, convenience in use may be improved.

Embodiments disclosed herein provide an indoor unit or device for a cassette type air conditioner including a grill restriction member configured to couple a suction grill to a panel so as to prevent an outer end of the suction grill from drooping downward.

Embodiments disclosed herein provide an indoor unit or device for a cassette type air conditioner that may include a cabinet, in which a heat exchanger and a blower may be mounted, the cabinet being installed on or in a ceiling in an inner or indoor space; a panel that defines a bottom surface of the cabinet, the panel having a suction hole and a discharge hole; a suction grill mounted to cover the suction hole of the panel; a fixing member disposed on one side of the suction grill, the fixing member being fixed to one side of the panel to restrict one end of the suction grill; a switching member disposed on the other side of the suction grill facing the fixing member, the switching member being selectively fixed to the one side of the panel to restrict the other end of the suction grill; and a grill restriction member disposed on each of both sides of the suction grill between the fixing member and the switching member, the grill restriction member being coupled to each of both sides of the panel to restrict both ends of the suction grill. Each of the fixing member and the switching member may be provided in plurality, and the plurality of fixing members and the switching members may be disposed to be laterally spaced apart from each other.

At least one portion of the switching member may be exposed through a suction hole defined in a lattice shape in the suction grill to allow a user to perform an opening/closing operation. The fixing member may include a fixed piece that extends outwardly and is inserted into one side of the panel.

A panel bracket mounted along a circumference of the suction hole to allow the grill restriction member to be restricted may be disposed on the panel. The panel bracket may include an inwardly recessed coupling part or portion, on which the grill restriction member having a hook shape may be hooked and restricted.

Each of the coupling part and the grill restriction member may be disposed at a middle point in a longitudinal direction of each of both sides of the suction grill. The grill restriction member may include an extension part or extension that extends upward from the suction grill, and a hook part or hook that protrudes laterally from an end of the extension part. The hook part may be hooked and restricted with the panel, and the hook part may have an inclined top surface.

A connection member may be disposed between the panel and the suction grill. The suction grill may be rotated by the connection member to open the suction hole.

A panel-side mount part or mount, on which the connection member may be slidably mounted, may be disposed on each of both sides of the panel, and a grill-side mount part or mount, to which the connection member may be rotatably coupled, may be disposed on each of both sides of the suction grill. The panel-side mount part may be provided in a pair on left and right or lateral sides of the panel, the pair of panel-side mount part may be symmetrical to each other, and the connection member may be selectively mounted on one of the panel-side mount parts according to an opened direction of the suction grill.

A filter guide, on which a filter case to accommodate an air filter may be fixed and mounted, may be disposed on each of both sides of the suction grill, and the grill restriction member may be integrated with the filter guide.

Embodiments disclosed herein may further provide an indoor unit or device for a cassette type air conditioner installed on or in a ceiling in an indoor space that may include a panel exposed to a bottom surface of the ceiling, the panel having a suction hole and discharge holes; a vane rotatably mounted in each of the discharge holes to guide a flow direction of discharged air; a suction grill openably mounted on a bottom surface of the panel, the suction grill being disposed to cover the suction hole; and a grill restriction member that protrude from each of both sides of the suction grill, the grill restriction member being inserted into the suction hole and hooked and restricted with the panel. A concave part or portion that extends to coincide with an inner line of the discharge hole may be defined in an outer end of the suction grill. The grill restriction member may be disposed at a middle portion in a longitudinal direction of the suction grill.

The grill restriction member may have a hook shape, and a top surface of the grill restriction member may be inclined to contact the panel when the suction grill is closed. The grill restriction member may be disposed to cross the switching member to manipulate an opening/closing of the suction grill.

The grill restriction member may include an extension part or extension that extends upward from a top surface of the suction grill, and a hook part or hook that protrudes outward from an end of the extension part to contact an opened inner end of the panel. A panel bracket having a central portion opened to correspond to the suction hole may be mounted on the panel, and the grill restriction member may be hooked and restricted with an opened inner end of the panel bracket.

A protrusion that extends between the plurality of discharge holes may be further disposed on an edge of the suction grill. A rounded groove having a closed loop shape, which may connect an outer line of the discharge hole, an outer line of the vane, and an outer line of the protrusion to each other may be defined in the panel. Both ends of each of the discharge hole and the vane may be gradually narrowed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device for a cassette type air conditioner, the indoor device comprising:

a cabinet, in which a heat exchanger and a blower fan are mounted, the cabinet being configured to be installed on a ceiling in an indoor space;

a panel that defines a bottom surface of the cabinet, the panel having at least one suction hole and at least one discharge hole;

a suction grill mounted to cover the at least one suction hole;

at least one fixing member disposed at a first side of the suction grill, the at least one fixing member being fixed to a first side of the panel to restrict movement of the first side of the suction grill;

at least one switching member disposed on a second side of the suction grill and facing the at least one fixing member, the at least one switching member being selectively fixed to a second side of the panel to restrict movement of the second side of the suction grill; and a suction grill restricter disposed on each of third and fourth sides of the suction grill between the at least one fixing member and the at least one switching member, the suction grill restricters being coupled to each of third and fourth sides of the panel to restrict movement of the third and fourth sides of the suction grill, wherein at least one connection member is disposed between the panel and the suction grill, wherein the suction grill is rotated by the at least one connection member to open the suction hole, wherein the at least one connection member is disposed closer to the at least one fixing member than the at least one connection member is to the at least one switching member, wherein the at least one connection member is disposed closer to the suction grill restricters than the at least one connection member is to the at least one switching member, and wherein the at least one switching member includes:

a fixed portion fixed to the suction grill;

a manipulation portion that extends from the fixed portion to move the fixed portion; and an elastic portion, having a plate shape which is inclined or curved, that extends to each of both sides of the manipulation portion and contacts a support wall when the manipulation portion is manipulated, wherein the support wall protrudes from the upper surface of the suction grill, and wherein the elastic portion is elastically deformed when manipulated to be in contact with the support wall.

2. The indoor device according to claim 1, wherein the at least one fixing member and the at least one switching member comprises a plurality of fixing members and a plurality of switching members disposed to be laterally spaced apart from each other, respectively.

3. The indoor device according to claim 1, wherein at least a portion of the at least one switching member is exposed through a suction hole defined in the suction grill to allow a user to perform opening and closing operations of the suction grill.

4. The indoor device according to claim 1, wherein the at least one fixing member comprises a fixed piece that extends outwardly and is inserted into the panel.

5. The indoor device according to claim 1, wherein the panel further comprises a panel bracket mounted along a circumference of the suction hole, the suction grill restricters being coupled with the panel bracket to restrict movement of the suction grill.

6. The indoor device according to claim 5, wherein each of the suction grill restricters is in the form of a hook, and wherein the panel bracket comprises a pair of inwardly recessed coupling portions, on which the hooks are hooked.

7. The indoor device according to claim 6, wherein each of the coupling portions and the pair of suction grill restricters are disposed at a middle portion of the side of the suction grill and panel.

8. The indoor device according to claim 1, wherein each suction grill restricter comprises:

an extension that extends upward from the suction grill; and a hook that protrudes laterally from an end of the extension, the hook being hooked on the panel, wherein the hook has an inclined upper surface.

9. The indoor device according to claim 1, wherein at least one panel-side mount, on which the at least one connection member is slidably mounted, is disposed on at least one of the first and second sides of the panel, and wherein at least one grill-side mount, to which the at least one connection member is rotatably coupled, is disposed on at least one of the first and second sides of the suction grill.

10. The indoor device according to claim 9, wherein the at least one panel-side mount comprises a pair of panel-side mounts provided on each of the first and second sides of the panel and disposed symmetrical with respect to each other, and wherein the at least one connection member is selectively mounted on one of the pair of panel-side mounts according to an opening direction of the suction grill.

11. The indoor device according to claim 1, wherein a filter guide, on which a filter case to accommodate an air filter is mounted, is disposed on each of the third and fourth sides of the suction grill, and wherein the suction grill restricters are integrated with the filter guide.

12. An indoor device for a cassette type air conditioner configured to be installed on a ceiling in an indoor space, the indoor device comprising:

a panel exposed through the ceiling, the panel having at least one suction hole and at least one discharge hole;

a vane rotatably mounted in each of the at least one discharge hole to guide a flow direction of discharged air;

a suction grill openably mounted on a bottom surface of the panel, the suction grill being disposed to cover the at least one suction hole; and a suction grill restricter that protrudes from each of first and second sides of the suction grill, the suction grill restricters being inserted into the suction hole and hooked on the panel, wherein an outer edge of the suction grill includes at least one concave portion that corresponds to an inner line of the at least one discharge hole, wherein a fixing member is disposed at a third side of the suction grill, the fixing member being fixed to a third side of the panel to restrict movement of the third side of the suction grill, wherein a switching member is disposed on a fourth side of the suction grill and facing the fixing member, the switching member being selectively fixed to a fourth side of the panel to restrict movement of the fourth side of the suction grill, wherein a connection member is disposed between the panel and the suction grill, wherein the suction grill is rotated by the connection member to open the suction hole, wherein the at least one connection member is disposed closer to the at least one fixing member than the at least one connection member is to the at least one switching member, wherein the at least one connection member is disposed closer to the suction grill restricters than the at least one connection member is to the at least one switching member, and wherein the at least one switching member includes:

a fixed portion fixed to the suction grill;

a manipulation portion that extends from the fixed portion to move the fixed portion; and an elastic portion, having a plate shape which is inclined or curved, that extends to each of both sides of the manipulation portion and contacts a support wall when the manipulation portion is manipulated, wherein the support wall protrudes from the upper surface of the suction grill, and wherein the elastic portion is elastically deformed when manipulated to be in contact with the support wall.

13. The indoor device according to claim 12, wherein each suction grill restricter is disposed at a middle portion of the suction grill.

14. The indoor device according to claim 12, wherein each suction grill restricter is in the form of a hook shape, a top surface of which is inclined to contact the panel when the suction grill is closed.

15. The indoor device according to claim 12, wherein each suction grill restricter comprises:

an extension that extends upward from a top surface of the suction grill; and a hook that protrudes laterally from an end of the extension to contact of the panel.

16. The indoor device according to claim 12, wherein the panel further comprises a panel bracket having a central portion opened to correspond to the at least one suction hole, and wherein the suction grill restricters are hooked on the panel bracket.

17. The indoor device according to claim 12, wherein the at least one discharge hole comprises a plurality of discharge holes, each having a vane rotatably mounted therein, and wherein the outer edge of the suction grill comprises a plurality of protrusions that extend, respectively, between the plurality of discharge holes grill.

18. The indoor device according to claim 17, wherein the panel further comprises a rounded groove having a closed loop shape, which connects outer lines of the plurality of discharge hole, outer lines of the plurality of vane, and outer lines of the plurality of protrusions.

19. The indoor device according to claim 12, wherein ends of each of the at least one discharge hole and vane are gradually narrowed.

20. An indoor device for an air conditioner, the indoor device comprising:

a case, in which are disposed a heat exchanger and a fan;

a panel disposed at a bottom of the case, wherein the case is configured to be mounted in a ceiling of an indoor space with the panel viewable to a user, the panel comprising a suction hole disposed at a central portion of the panel and a plurality of discharge holes that extend along sides of the panel between the suction hole and an outer edge of the panel;

a suction grill mounted to cover the suction hole;

at least one fixing member disposed at a first side of the suction grill, the at least one fixing member being fixed to a first side of the panel to fix the first side of the suction grill to the panel;

at least one switching member disposed on a second side of the suction grill and facing the at least one fixing member, the at least one switching member being selectively fixed to a second side of the panel to fix the second side of the suction grill to the panel; and a pair of suction grill restricters disposed, respectively, at a central portion of third and fourth sides of the suction grill, the pair of suction grill restricters being coupled to third and fourth sides of the panel to fix the third and fourth sides of the suction grill to the panel, wherein at least one connection member is disposed between the panel and the suction grill, wherein the suction grill is rotated by the at least one connection member to open the suction hole, wherein the at least one connection member is disposed closer to the at least one fixing member than the at least one connection member is to the at least one switching member, wherein the at least one connection member is disposed closer to the suction grill restricters than the at least one connection member is to the at least one switching member, and wherein the at least one switching ember includes:

a fixed portion fixed to the suction grill;

a manipulation portion that extends from the fixed portion to move the fixed portion, and an elastic portion, having a plate shape which is inclined or curved, that extends to each of both sides of the manipulation portion and contacts a support wall when the manipulation portion is manipulated, wherein the support wall protrudes from the upper surface of the suction grill, and wherein the elastic portion is elastically deformed when manipulated to be in contact with the support wall.

21. The indoor device according to claim 20, wherein the at least one fixing member and the at least one switching member comprises a plurality of fixing members and a plurality of switching members disposed to be laterally spaced apart from each other, respectively.

22. The indoor device according to claim 20, wherein the suction grill is rotatably mounted on the panel.

23. The indoor device according to claim 22, wherein at least a portion of the at least one switching member is exposed through a suction hole defined in the suction grill to allow a user to perform opening and closing operations of the suction grill.

24. The indoor device according to claim 20, wherein the at least one fixing member comprises a fixed piece that extends outwardly and is inserted into the panel.

25. The indoor device according to claim 20, wherein the panel further comprises a panel bracket mounted along a circumference of the suction hole, the pair of suction grill restricters being coupled to the panel bracket to fix the suction grill to the panel.

26. The indoor device according to claim 20, wherein each suction grill restricter comprises:

an extension that extends upward from the suction grill; and a hook that protrudes laterally from an end of the extension, the hook being hooked on the panel, wherein the hook has an inclined upper surface.

27. The indoor device according to claim 1, wherein the at least one fixing member is configured to be completely separated from the panel when the suction grill is removed from the panel.

28. The indoor device according to claim 20, wherein the at least one fixing member is configured to be completely separated from the panel when the suction grill is removed from the panel.

* * * * *